United States Patent [19]

Armanto

[11] Patent Number: 5,000,217

[45] Date of Patent: Mar. 19, 1991

[54] APPARATUS FOR KEEPING A RAIN WATER WELL UNFROZEN

[75] Inventor: Heikki Armanto, Turku, Finland

[73] Assignee: Kiinteistojen LVI-Palvelu ja Suunnittelu H. Armanto KY, Turku, Finland

[21] Appl. No.: 469,409

[22] PCT Filed: Aug. 17, 1988

[86] PCT No.: PCT/FI88/00132

§ 371 Date: Apr. 2, 1990

§ 102(e) Date: Apr. 2, 1990

[87] PCT Pub. No.: WO89/03460

PCT Pub. Date: Apr. 20, 1989

[30] Foreign Application Priority Data

Oct. 7, 1987 [FI] Finland ..... 874394

[51] Int. Cl.[5] ..... F16L 5/00

[52] U.S. Cl. ..... 137/363; 137/582; 405/127; 52/20

[58] Field of Search ..... 137/363, 582, 592, 236.1; 52/20, 19, 169.5; 405/127, 118

[56] References Cited

U.S. PATENT DOCUMENTS

| | | | |
|---|---|---|---|
| 316,567 | 4/1885 | Pierson | 137/363 |
| 965,861 | 8/1910 | Berwanger . | |
| 2,602,465 | 7/1952 | Goehring | 137/582 |
| 3,927,534 | 12/1975 | Larson et al. | 405/127 |
| 4,486,122 | 12/1984 | Arntyr et al. | 405/157 |
| 4,505,814 | 3/1985 | Marshall | 52/20 |

FOREIGN PATENT DOCUMENTS

| | | | |
|---|---|---|---|
| 277079 | 12/1969 | Fed. Rep. of Germany | 405/80 |
| 327806 | 8/1970 | Sweden . | |
| 430705 | 4/1982 | Sweden . | |
| 5888 | of 1894 | United Kingdom . | |
| 20025 | of 1899 | United Kingdom | 137/363 |

*Primary Examiner*—A. Michael Chambers
*Attorney, Agent, or Firm*—Nixon & Vanderhye

[57] ABSTRACT

The invention relates to an apparatus for keeping a rain water well unfrozen. The apparatus comprises a cover (12), walls (13) and an outlet (15), which defines an air space (16) of the well above the outlet and a water space (17) of the well below the outlet. According to the present practice, the whole surface area of the water in a rain water well is in contact with open air, which results in that the well freezes relatively easily under the joint influence of wind and frost. This problem is solved according to the invention in such a way that the apparatus comprises a funnel (1) positioned under the cover (12) of the well and a flow tube (5), the cross section of which is substantially smaller than the diameter of the well and which tube extends from the lower part of the funnel (1) under the water surface of the well.

16 Claims, 2 Drawing Sheets

APPARATUS FOR KEEPING A RAIN WATER WELL UNFROZEN

The invention relates to an apparatus for keeping a rain water well unfrozen, which well comprises a cover, walls and an outlet, which defines an air space of the well above the outlet and a water space of the well below the outlet. By means of the apparatus of the invention, heat losses of the rain water well can be minimized without risking the flow capacity of the rain water well at all.

According to the present practice, the whole surface area of the water in a rain water well is in contact with open air. Then the well freezes relatively easily under the joint influence of wind and frost. The object of the present invention is to get rid of this drawback and to provide an apparatus by means of which the contact surface between the open air and the water in a rain water well can be minimized. This is achieved by means of an apparatus of the invention in such a way that the apparatus comprises a funnel positioned under the cover of the well and a flow tube, the cross section of which is substantially smaller than the diameter of the well and which tube extends from the lower part of the funnel under the water surface of the well.

According to a very preferable embodiment of the invention, a closed flow plate substantially parallel to the well cover is arranged in the funnel, which plate is broader than the diameter of the flow tube, but narrower than the funnel diameter at the corresponding height. When the water inflow is sufficiently strong, the closed flow plate makes it possible to conduct the water by a closed flow method known per se (Swedish Patent 327806) under the surface of the water space of the rain water well. Due to closed flow, the transfer capacity of the flow tube improves substantially, whereby its diameter can be dimensioned smaller than before.

By means of the apparatus of the invention, the contact surface between the water and the air in the most common well types decreases by approximately 98 per cent with respect to the present surface, and no movable parts are necessary in this apparatus. Tests have proved that the flow capacity of the apparatus is sufficient for the water transmission capacity of the cover of a rain water well with a diameter of 600 mm.

Figure 1:
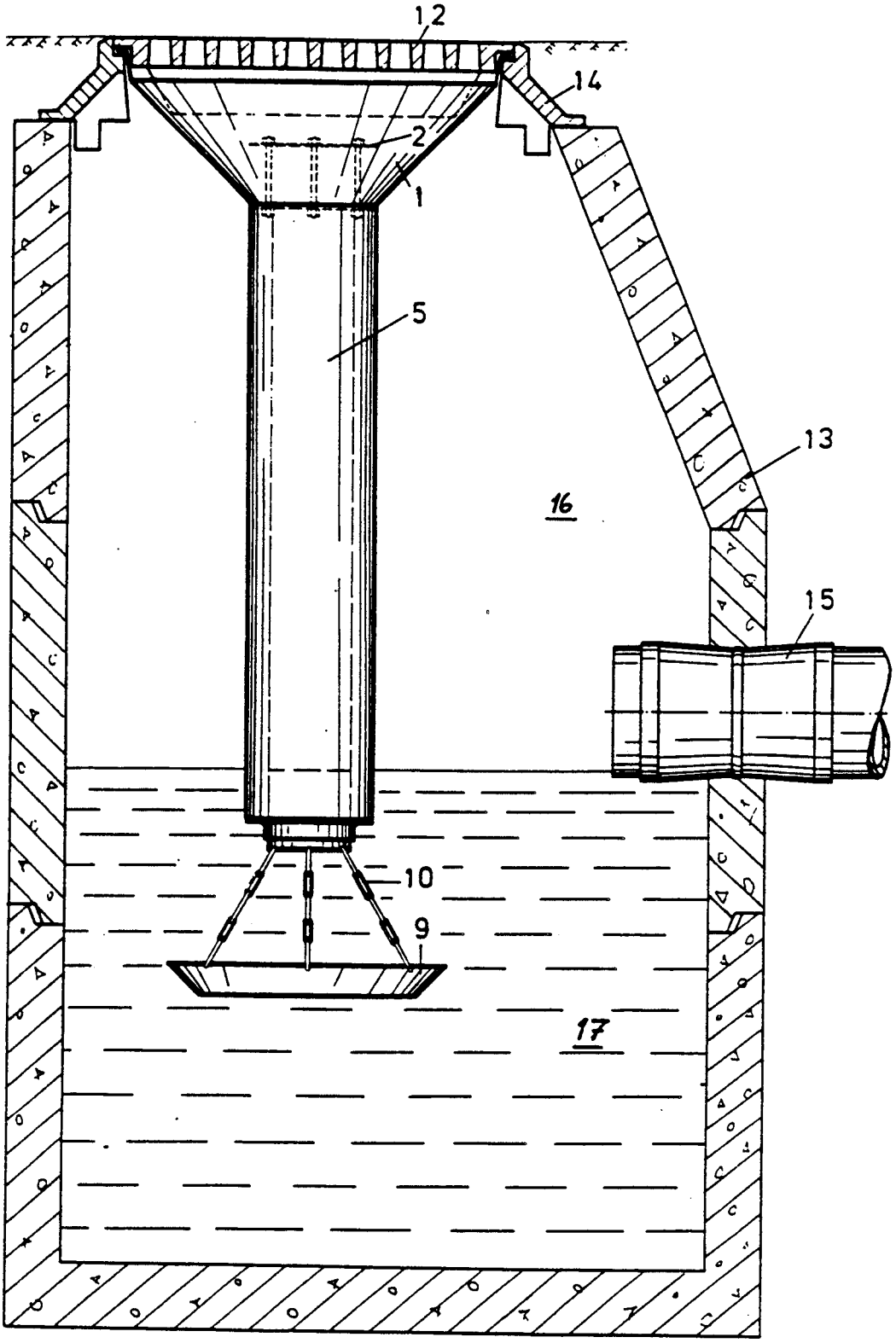
Figure 2:
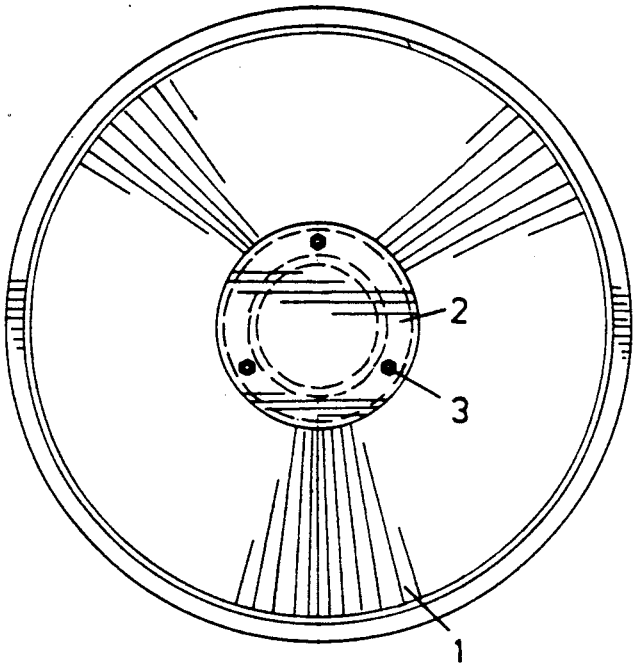
Figure 3:
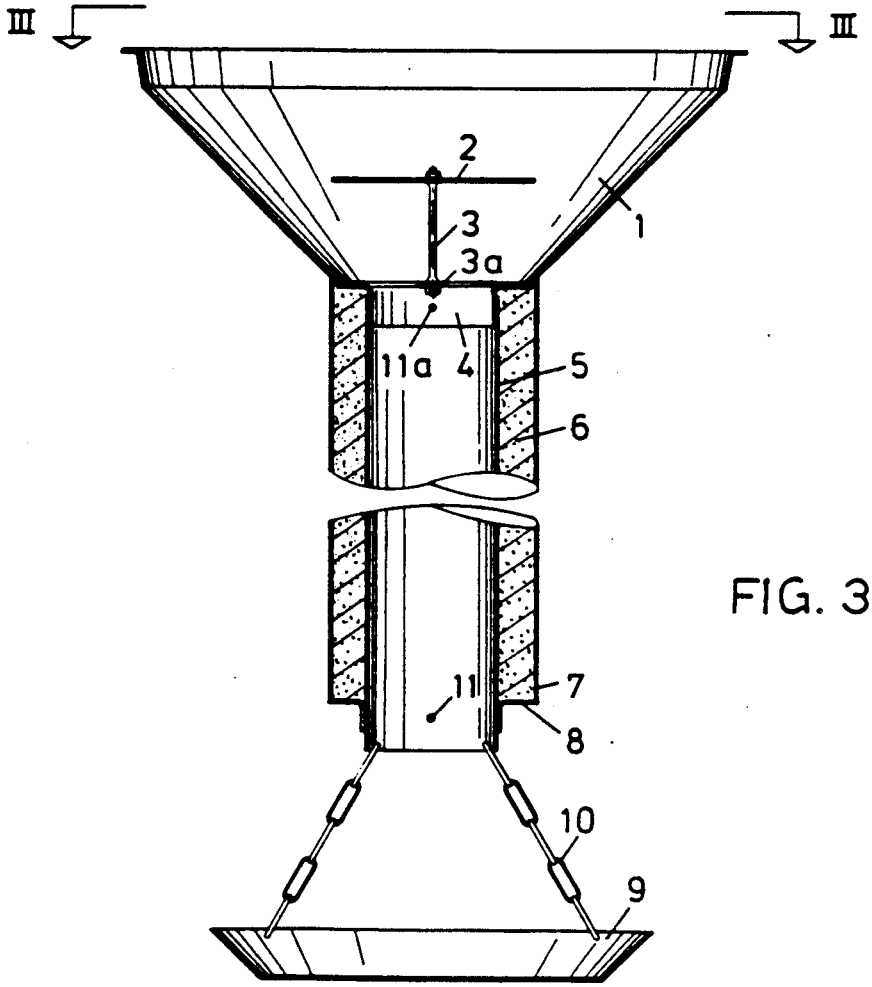

In the following, the invention is explained in greater detail with reference to the example of the enclosed drawings, wherein FIG. 1 illustrates an apparatus of the invention installed in a rain water well shown in axial section, FIG. 2 illustrates the apparatus of the invention in axial section, and FIG. 3 illustrates a funnel of the apparatus provided with a closed flow plate seen from above from the direction of the line III—III of FIG. 2.

FIG. 1 shows a typical rain water well comprising walls 13 defining the well space, a frame 14 installed at the upper edge of the walls and a cover 12 installed in the frame. An outlet 15 fastened to the wall of the well defines an air space 16 of the well above the outlet and a water space 17 of the well below the outlet. The apparatus according to the invention is suspended in a space reserved for the cover in the frame 14.

FIG. 2 shows a cross section of the apparatus of the invention comprising a funnel 1 and a flow tube 5, the cross section of which is substantially smaller than the diameter of the well and which tube extends from the lower part of the funnel below the water surface of the well according to FIG. 1. To the horizontal lower part of the funnel are fastened substantially vertical supporting arms 3 extending upwards, to the upper end of which again is fastened, a substantially horizontal closed flow plate 2 making a generation of closed flow possible. Further, an exit collar 4 extending downwards is fastened to the lower part of the funnel 1 by means of bolts 3*a* of the supporting arms 3. The flow tube 5 is fastened to the exit collar by means of for instance pop rivets 11*a*. To the lower end of the flow tube is in a similar way by means of for instance pop rivets 11 fastened a supporting collar 8, on which is installed a protecting tube 7. The space between the protecting tube and the flow tube is filled with urethane foam 6 to minimize the heat losses of the flow tube. Additionally, the apparatus comprises a flow controller consisting of a trough 9, which is suspended in the lower end of the flow tube by means of chains 10.

FIG. 3 shows the funnel 1 and the closed flow plate 2 from above. As is seen from FIG. 2 and 3, the diameter of the closed flow plate is greater than the diameter of the flow tube 5, but substantially smaller than the diameter of the funnel at the corresponding height.

In case of rain the funnel 1 receives the water flowing through the cover 12 of the well and leads it into the flow tube 5. When the water inflow is that strong that the surface of the water rises over the closed flow plate 2, a closed flow is generated in the flow tube, whereby the transfer capacity of the flow tube improves substantially. The lower end of the flow tube extends 70 to 120 mm under the water surface of the rain water well, whereby a water lock is formed preventing the water space of the well from airing. Because the flow rate of water becomes relatively high ($>2$ m/s) at closed flow, a flow controller consisting of a trough 9 is placed under the mouth of the tube, by means of which controller the flow in the well is controlled obliquely upwards, which prevents the sludge gathered in a sink trap of the well from mixing. Because the funnel 1 tightens the upper part of the well, only the water inside the flow tube 5 remains in direct contact with open air. The heat loss generated from this and losses due to heat conduction from the funnel and the flow tube will be the only heat losses released into open air. Because the well continuously receives heat of earth, its possibilities to remain unfrozen improve decisively when the apparatus of the invention is used.

Though the invention is explained above by referring to the example of the enclosed drawings, it is clear that the invention is not restricted to that but it can be varied in many ways within the scope of the inventive idea of the enclosed claims. Thus for instance, the funnel can also be rectangular or the exit collar can form a part of the funnel.

I claim:

1. A rain water well with enhanced freeze resistance, comprising:

a plurality of walls defining a volume which comprises the well;

an outlet from the well at an intermediate point, so that a portion of the volume defined by the walls is above the outlet and in use constitutes an air space, and a portion of the volume defined by the walls is below the outlet, and constitutes a water space in use;

an inlet cover adjacent the top of the walls, for allowing water to pass therethrough into the well;

a funnel having a top portion disposed under the cover for receipt of water passing through the cover, and tapering inwardly toward a bottom portion thereof;

a flow tube extending downwardly from the funnel, and having a cross-section substantially smaller than the cross-section of the well so that the tube is spaced from the walls, said tube having an open top connected to said funnel bottom portion, and an open bottom disposed below the outlet, in the water space;

a solid flow plate having a cross-section greater than the internal cross-section of the flow tube; and means for mounting the solid flow plate within the funnel above the top of the flow tube so that the solid flow plate is spaced around its periphery from the funnel so that water can flow along the funnel into the flow tube, but will not flow directly into the flow tube through the cover.

2. Apparatus as recited in claim 1 further comprising a flow controller disposed at the lower end of the flow tube for dispersing water flowing out the open bottom of the flow tube.

3. Apparatus as recited in claim 2 wherein said flow controller comprises a trough suspended by chains from the open bottom of the flow tube.

4. Apparatus as recited in claim 3 further comprising a protecting tube surrounding said flow tube, and defining a space therebetween; and thermal insulation disposed between said protecting tube and said flow tube.

5. Apparatus as recited in claim 3 wherein said trough has a cross-sectional area significantly greater than the cross-sectional area of the open bottom of said flow tube.

6. Apparatus as recited in claim 3 wherein said means for mounting said solid plate comprise a plurality of vertical supporting arms disposed around the periphery of the bottom portion of said funnel and interconnected between the bottom portion of said funnel and said plate.

7. Apparatus as recited in claim 6 wherein said plurality of vertical supporting arms comprises three supporting arms evenly arcuately spaced around said plate, and wherein said plate has a circular cross-section, and wherein said funnel has a circular cross-section.

8. Apparatus as recited in claim 6 wherein said trough has a cross-sectional area significantly greater than the cross-sectional area of the open bottom of said flow tube.

9. Apparatus as recited in claim 6 further comprising a protecting tube surrounding said flow tube, and defining a space therebetween; and thermal insulation disposed between said protecting tube and said flow tube.

10. Apparatus as recited in claim 2 wherein said means for mounting said solid plate comprise a plurality of vertical supporting arms disposed around the periphery of the bottom portion of said funnel and interconnected between the bottom portion of said funnel and said plate.

11. Apparatus as recited in claim 10 wherein said plurality of vertical supporting arms comprises three supporting arms evenly arcuately spaced around said plate, and wherein said plate has a circular cross-section, and wherein said funnel has a circular cross-section.

12. Apparatus as recited in claim 1 further comprising a protecting tube surrounding said flow tube, and defining a space therebetween; and thermal insulation disposed between said protecting tube and said flow tube.

13. Apparatus as recited in claim 12 wherein said means for mounting said solid plate comprise a plurality of vertical supporting arms disposed around the periphery of the bottom portion of said funnel and interconnected between the bottom portion of said funnel and said plate.

14. Apparatus as recited in claim 13 wherein said plurality of vertical supporting arms comprises three supporting arms evenly arcuately spaced around said plate, and wherein said plate has a circular cross-section, and wherein said funnel has a circular cross-section.

15. Apparatus as recited in claim 1 wherein said means for mounting said solid plate comprise a plurality of vertical supporting arms disposed around the periphery of the bottom portion of said funnel and interconnected between the bottom portion of said funnel and said plate.

16. Apparatus as recited in claim 15 wherein said plurality of vertical supporting arms comprises three supporting arms evenly arcuately spaced around said plate, and wherein said plate has a circular cross-section, and wherein said funnel has a circular cross-section.

* * * * *